US007734239B2

(12) United States Patent
Murashima

(10) Patent No.: US 7,734,239 B2
(45) Date of Patent: Jun. 8, 2010

(54) FIXING DEVICE, IMAGE FORMING APPARATUS AND SHEET CONVEYING DEVICE

(75) Inventor: Masaki Murashima, Osaka (JP)

(73) Assignee: Kyocera Mita Corporation (JP)

( * ) Notice: Subject to any disclaimer, the term of this patent is extended or adjusted under 35 U.S.C. 154(b) by 210 days.

(21) Appl. No.: 11/881,459

(22) Filed: Jul. 27, 2007

(65) Prior Publication Data

US 2008/0025769 A1 Jan. 31, 2008

(30) Foreign Application Priority Data

Jul. 31, 2006 (JP) ..... 2006-208795

(51) Int. Cl.
*G03G 21/00* (2006.01)
*B65H 29/54* (2006.01)

(52) U.S. Cl. ..... 399/323; 399/399; 271/311

(58) Field of Classification Search ..... 399/322, 399/323, 397–399; 271/307, 311, 900
See application file for complete search history.

(56) References Cited

U.S. PATENT DOCUMENTS 6,029,038 A 2/2000 Uehara et al.
6,735,412 B2 * 5/2004 Berg et al. ..... 399/323
2007/0086814 A1 * 4/2007 Fujiwara ..... 399/323

FOREIGN PATENT DOCUMENTS

| | | |
|---|---|---|
| JP | 6-32516 | 2/1994 |
| JP | 11-184300 | 7/1999 |
| JP | 2002-82564 | 3/2002 |
| JP | 2002-287554 | 10/2002 |
| JP | 2005-99676 | 4/2005 |

* cited by examiner

*Primary Examiner*—David M Gray
*Assistant Examiner*—Gregory H Curran
(74) *Attorney, Agent, or Firm*—Gerald E. Hespos; Michael J. Porco

(57) ABSTRACT

A fixing device includes a pair of rotating bodies forming a nip portion, for fixing an image formed on the surface of a sheet to the sheet; and a separating pawl having a leading end portion and a tailing end portion, a tip part of the leading end portion being made press contact with a surface of at least one of the pair of rotating bodies. The separating pawl includes a pivotal portion integrally formed between the leading end portion and the tailing end portion, and the tailing end portion has a spring property capable of adjusting the press-contact force of the tip part.

23 Claims, 14 Drawing Sheets

FIXING DEVICE, IMAGE FORMING APPARATUS AND SHEET CONVEYING DEVICE

BACKGROUND OF THE INVENTION

1. Field of the Invention

The present invention relates to a fixing device for fixing an image formed on a surface of a sheet, and to an image forming apparatus provided with the fixing device, and to a sheet conveying device.

2. Description of the Related Art

Conventionally, an image forming apparatus, such as a printer, a copying machine, a facsimile, and a composite machine constituted by functionally combining these, includes a fixing device for fixing a toner image formed on the surface of a transfer sheet to the transfer sheet. The fixing device includes a fixing roller pair consisting of a heating roller for melting a toner, and a pressing roller made press contact with the heating roller. Further, there is known an image forming apparatus mounted with a fixing device having a separating pawl whose tip part is made press contact with the surface of at least one of the fixing roller pair (for example, see Japanese Patent Laid-Open No. 2005-099676, Japanese Patent Laid-Open No. 11-184300, Japanese Patent Laid-Open No. 2002-082564, Japanese Patent Laid-Open No. 06-032516, Japanese Patent Laid-Open No. 2002-287554).

The separating pawl is arranged on a downstream side in the conveying direction of the sheet with respect to the fixing roller pair, and prevents the sheet from being kept stuck to the fixing roller pair by being made press contact with the surface of one of the heating roller and the pressing roller.

Further, for the fixing of the separating pawl, there is adopted a technique by which the trailing edge of the separating pawl is stuck and fixed to a thin-walled bracket and the like, and the thin-walled bracket is fixed to a device main body or a unit-like fixing device with screws.

However, in the fixing device constituted as described above, since the trailing edge of the separating pawl is stuck and fixed to the thin-walled bracket and the like, the sticking work of the separating pawl is needed separately from the mounting work of the thin-walled bracket. This causes the number of components of the fixing device to be increased, and causes the mounting work of the components to be complicated, resulting in a problem that the fixing device is inferior in terms of versatility.

Further, it is necessary to prepare the thin-walled bracket for holding the separating pawl, which corresponds to the length, width, wall thickness and the like, of the separating pawl. For this reason, a plurality of kinds of separating pawls, thin-walled brackets and the like, need to be prepared for every model and the like of fixing devices so as to correspond to each other, which results in a problem that the control of inventory including molding dies is very troublesome.

Further, in the case where the separating pawl is adapted to be held by the thin-walled bracket, it is necessary to exchange the whole thin-walled bracket when the separating pawl is exchanged. For this reason, even when the separating pawl needs to be exchanged during the maintenance work, it is difficult to exchange the separating pawl on the spot. As a result, the maintenance work (exchanging work) needs to be performed again after component procurement or the like.

This causes a problem that the versatility is also lowered from a viewpoint of the maintenance.

SUMMARY OF THE INVENTION

It is an object of the present invention to provide a fixing device and an image forming apparatus, which can reduce the number of components and improve the versatility of the separating pawl.

According to an aspect of the present invention, a fixing device comprises: a pair of rotating bodies forming a nip portion, for fixing an image formed on a surface of a sheet; and a separating pawl having a leading end portion and a tailing end portion, a tip part of the leading end portion being made press contact with a surface of at least one of the pair of rotating bodies, and having a pivotal portion integrally formed between the leading end portion and the tailing end portion. The tailing end portion has a spring property capable of adjusting press-contact force of the tip part.

Further, according to another aspect of the present invention, an image forming apparatus including: an image forming portion adapted to perform transfer processing to transfer a toner image onto a sheet; and a fixing portion adapted to perform fixing processing of the toner image by heating the sheet. The fixing portion includes the constitution of the above-mentioned fixing device.

Further, according to still another aspect of the present invention, a sheet conveying device comprises: a conveying body having a rotating conveying surface capable of conveying a sheet in a close contact state; and a separating pawl having a leading end portion and a tailing end portion, a tip part of the leading end portion being made press contact with the conveying surface of the conveying body, and having a pivotal portion integrally formed between the leading end portion and the tailing end portion. The tailing end portion has a spring property capable of adjusting press-contact force of the tip part.

DETAILED DESCRIPTION OF THE PREFERRED EMBODIMENTS

Preferred embodiments according to the present invention will be described in detail with reference to the accompanying drawings.

(Entire Constitution of a Composite Machine)

Figure 1:
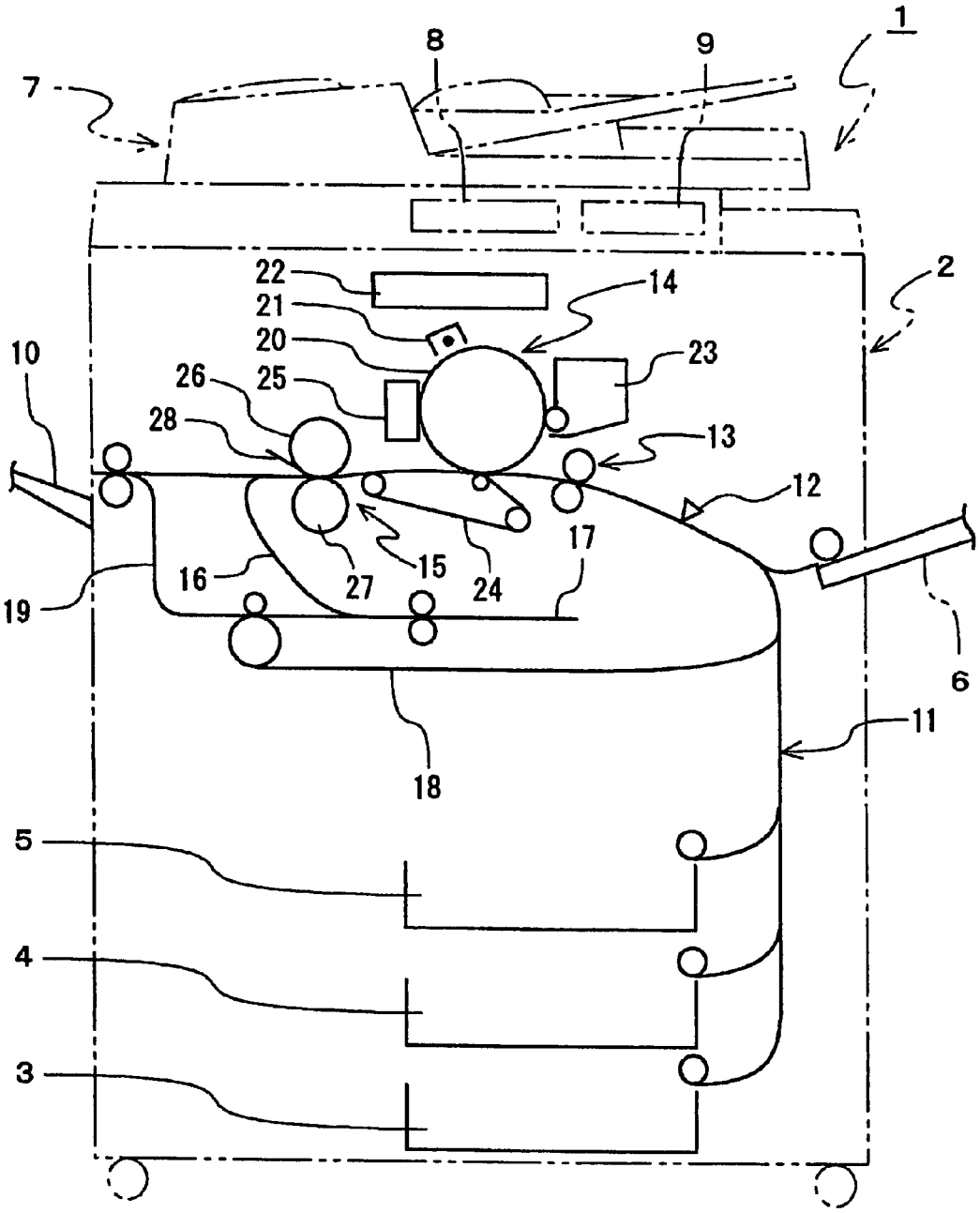
FIG. 1 is a schematic cross-sectional view of an image forming apparatus according to an embodiment of the present invention.

FIG. 1 is an illustration of a composite machine 1 (image forming apparatus) having a fixing device according to an embodiment of the present invention. In FIG. 1, the composite machine 1 is an image forming apparatus which has respective functions such as those of a copying machine, a printer, a scanner, a facsimile and the like, and to which the fixing device is applied.

The composite machine 1 includes a plurality of stages of sheet tray units 3, 4 and 5 which can be drawn out from the front surface of the apparatus main body 2, a manual feed tray 6 provided in the side surface of the apparatus main body 2, an automatic document feeder 7 (hereinafter referred to as "ADF") used at the time of reading a document by a scanner portion (not shown) serving as a function of each of a copying machine, a facsimile and a scanner, a display screen 8 on which various setting conditions or the like are displayed and which has a panel switch function, and an operating portion 9, for performing operations other than the operation on the display screen 8, or the like. A display screen of a panel switch type is adopted as the display screen 8 so as to make it possible to change the setting of magnification/reduction ratios, and the like. The operating portion 9 includes a start switch, a mode selection switch, a clear switch, a ten-key switch, and the like.

Further, the apparatus main body 2 includes a conveyance path 11 therein, which takes out a transfer sheet (not shown) stored in the sheet tray units 3, 4 and 5, and conveys the transfer sheet toward a paper discharge tray 10. In the apparatus main body 2, a resist sensor 12, a resist roller pair 13, an image forming portion 14, and a fixing device 15 are arranged in order toward the downstream side in the sheet conveying direction from the manual feed tray 6 in the conveyance path 11. A branch path 16 branched from the conveyance path 11 is provided in the downstream side from the fixing device 15.

Further, a switchback path 17, a reverse path 18, and a reverse discharge path 19 are provided in the apparatus main body 2. The switchback path 17 serves to exchange the front and rear of the transfer sheet in the conveying direction, in order to reverse the front and rear surfaces of the transfer sheet conveyed in the branch path 16 (at the time of conveyance). The reverse path 18 is a path serving, when image formation processing is performed to both sides of the transfer sheet, to return the transfer sheet to the conveyance path 11 on the upstream side from the resist sensor 12 after the front and rear of the transfer sheet in the conveying direction is exchanged in the switchback path 17. The reverse discharge path 19 is a path serving, when the front and rear surfaces of the transfer sheet are reversed after image formation, to discharge the transfer sheet from the paper discharge tray 10 after the front and rear of the transfer sheet in the conveying direction is exchanged in the switchback path 17.

The image forming portion 14 includes a photoreceptor drum 20, an electrifying device 21 arranged around the photoreceptor drum 20, an exposing device 22, a developing device 23, a transfer device 24, a cleaning device 25, and the like.

Embodiment 1

Figure 2:
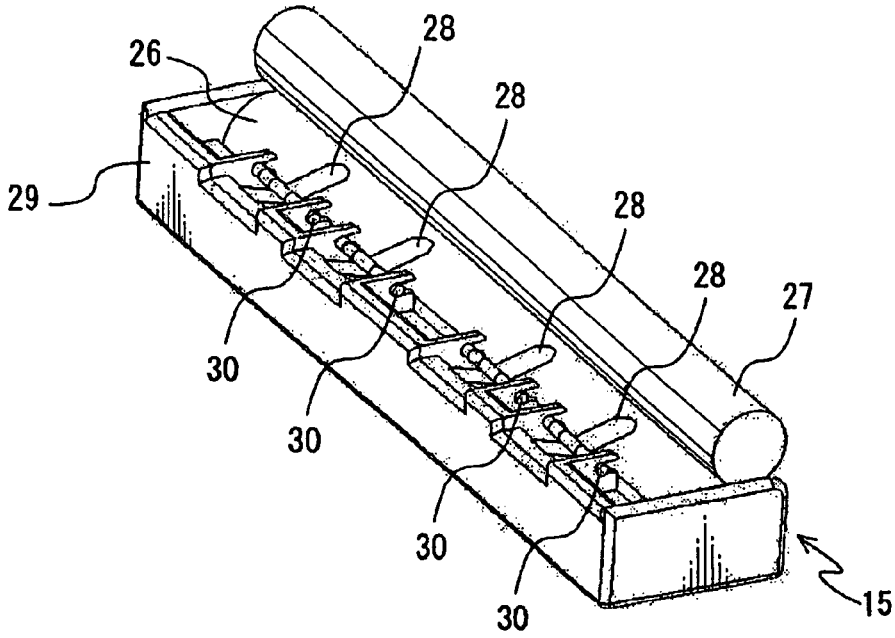
FIG. 2 is a perspective view of a fixing device according to the embodiment of the present invention viewed from the bottom surface thereof.
Figure 3:
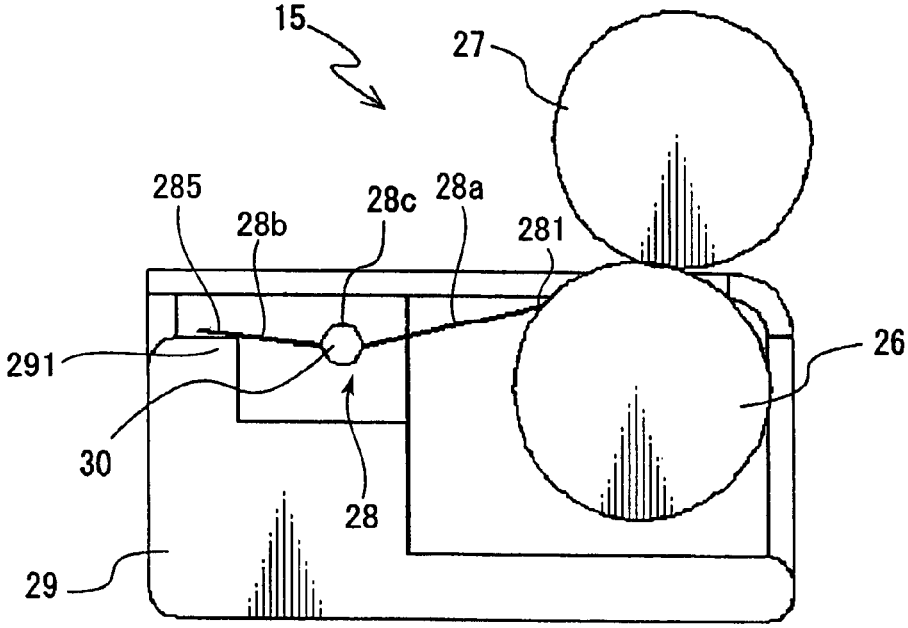
FIG. 3 is a sectional side view of the fixing device.
Figure 4:
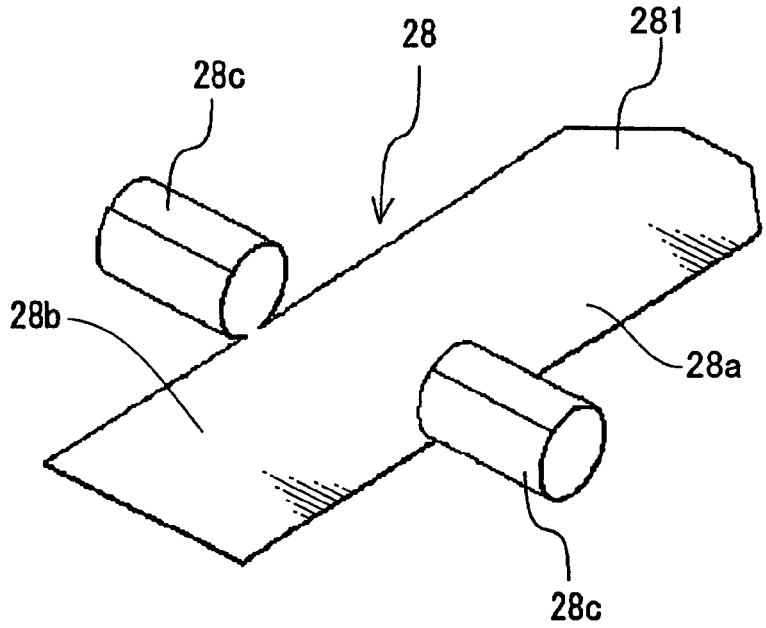
FIG. 4 is a perspective view of a separating pawl provided in the fixing device.
Figure 5:
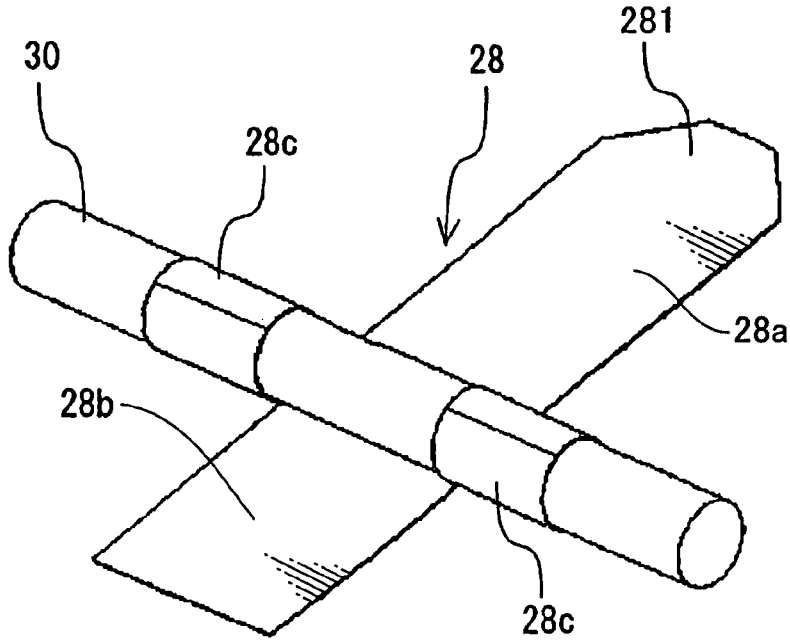
FIG. 5 is a perspective view in a state of making a shaft pass through the separating pawl.
Figure 6:
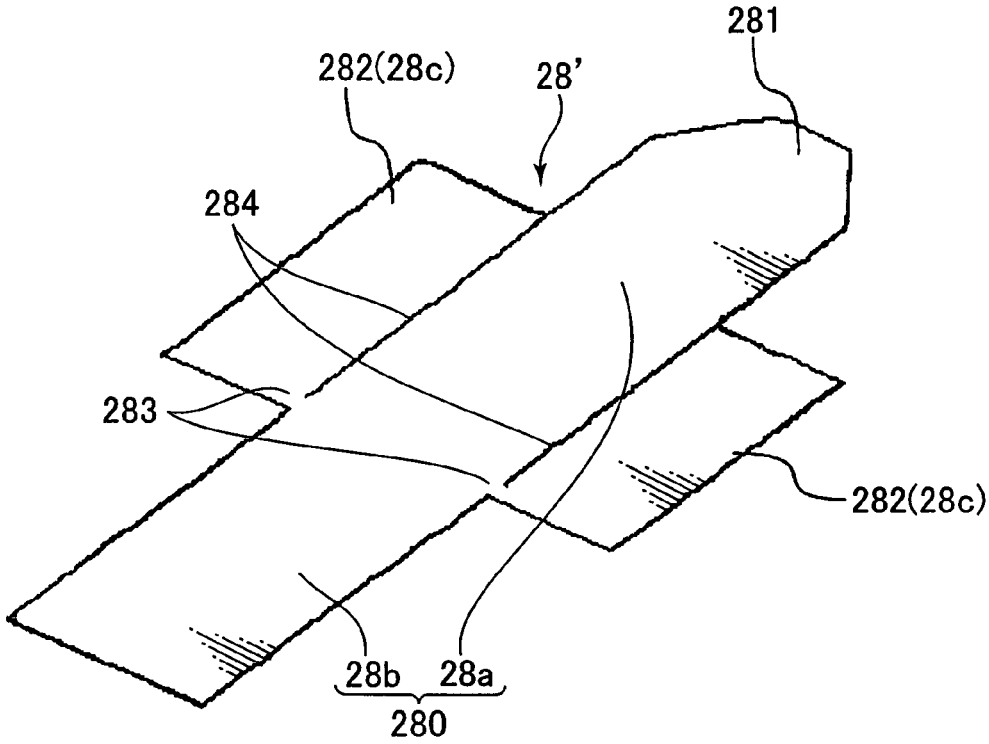
FIG. 6 is an exploded perspective view of the separating pawl.
Figure 7:
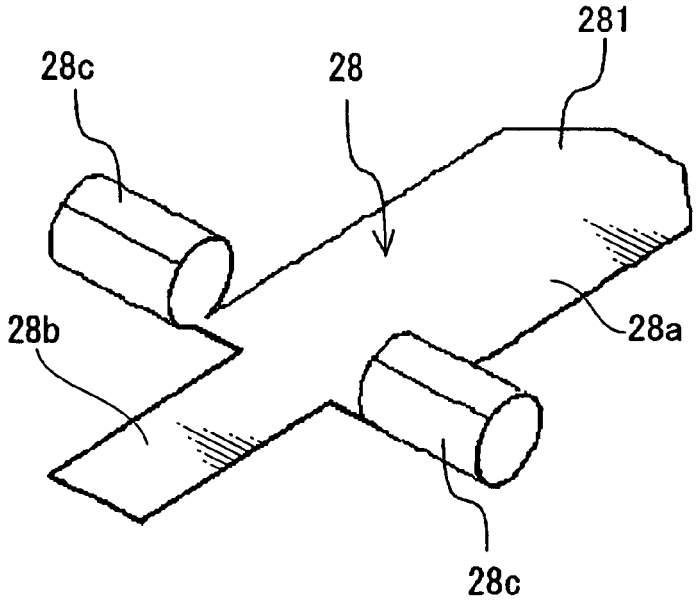
FIGS. 7 to 9 are perspective views of modifications of the separating pawl according to the embodiment.
Figure 8:
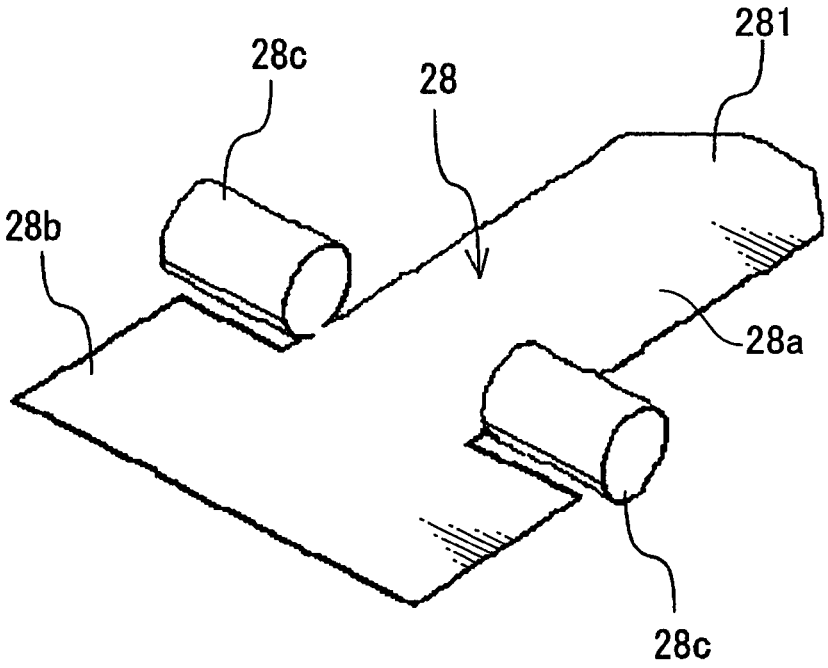
Figure 9:
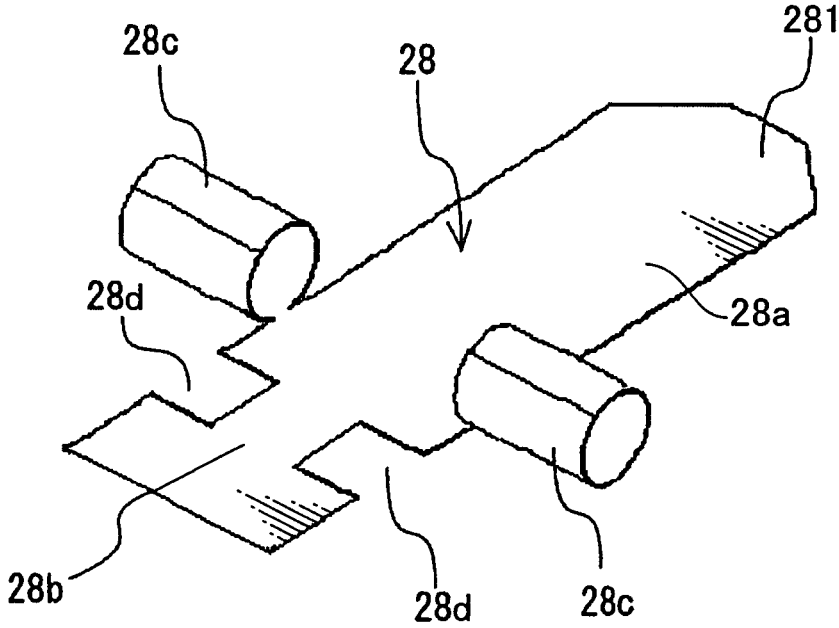
Figure 10:
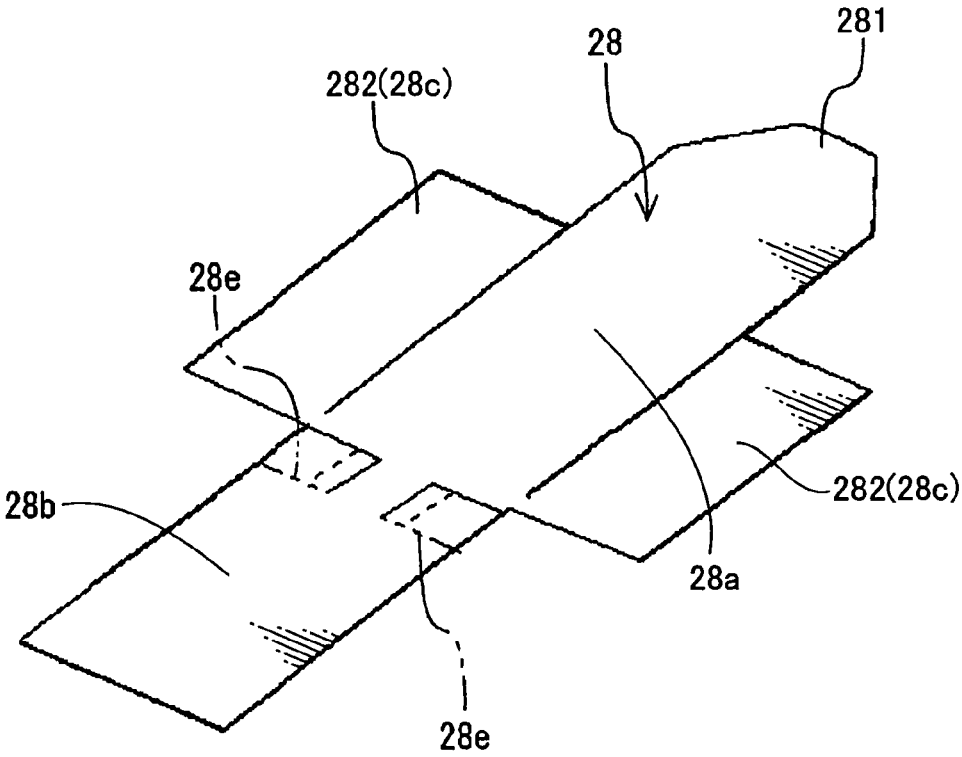
FIG. 10 is an exploded perspective view of another modification of the separating pawl.

FIG. 2 to FIG. 10 show a fixing device 15 according to embodiment 1. FIG. 2 is a perspective view of the fixing device viewed from the bottom surface thereof. FIG. 3 is a sectional side view of the fixing device 15. FIG. 4 is a perspective view of a separating pawl 28. FIG. 5 is a perspective view in the state of making a shaft 30 pass through the separating pawl 28. FIG. 6 is an exploded perspective view of the separating pawl 28. FIG. 7 to FIG. 9 are perspective views of modifications of the separating pawl 28 of embodiment 1. FIG. 10 is an exploded perspective view of another modification of the separating pawl 28 of embodiment 1.

As shown in FIG. 2 and FIG. 3, the fixing device 15 includes a fixing roller 26 which forms a nip portion for fixing a toner image (as will be described below) formed on the surface of the transfer sheet by the image forming portion 14, and a pressing roller 27 which is made press contact with the fixing roller 26 so as to press the transfer sheet against the fixing roller 26. Further, the fixing device 15 includes a plurality of separating pawls 28 whose tip part is made press contact with the surface of the fixing roller 26, and a case 29 which hold these in a state of a unit.

A heating member such as a halogen heater 50 is provided in the inside of the fixing roller 26, and the surface of the fixing roller 26 is heated by the heating member. Aluminum, iron or the like is used as the material of the fixing roller 26. Rubber having heat resistance property is used for the pressing roller 27. A pair of rotating bodies according to the claimed invention are constituted by the fixing roller 26 and the pressing roller 27. The present embodiment shows an example in which the separating pawl 28 is made press contact with the fixing roller 26 of the pair of rotating bodies.

In the present embodiment, the separating pawl 28 is constituted by a processed article of a plate shaped member having a spring property. As the plate shaped member, it is possible to use, for example, a metal plate which has a thickness of 0.03 to 0.1 mm, and is made of stainless steel, phosphor bronze, or the like. Further, it is preferred that coating processing of coating or sticking fluororesin is applied to at least the contact surface side with the fixing roller 26.

As shown in FIG. 4, the separating pawl 28 has a leading end portion 28*a* and a tailing end portion 28*b*. A tip part 281 which is made press contact with the roller surface of the fixing roller 26 is formed in the leading end portion 28*a*. Between the leading end portion 28*a* and the tailing end portion 28*b*, a pivotal portion 28*c* formed integrally with these portions is provided. As shown in FIG. 5, the pivotal portion 28*c* is molded into a cylindrical shape, and is formed in a state of bearing. The shaft 30 held by the case 29 is made to pass through the pivotal portion 28*c*.

FIG. 6 shows a shape of a plate shaped member 28' before the pivotal portion 28*c* of the separating pawl 28 shown in FIG. 4 and FIG. 5 is molded. The plate shaped member 28' is provided with a main body portion 280 having a strip-shaped planar form, and a pair of side portions 282 arranged at both sides of the main body portion 280.

The main body portion 280 and the side portion 282 are separated by a slit processing portion 284 except a tie bar portion 283. In other words, the side portion 282 is connected integrally with the main body portion 280 by the tie bar portion 283 (local connecting portion). The tie bar portion 283 is formed substantially at the central position of the main body portion 280 in the longitudinal direction. The main body portion 280 is in the form in which the leading end portion 28*a* and the tailing end portion 28*b* are linearly connected to each other, and the tie bar portion 283 serves as a boundary portion therebetween.

The tip part 281 is formed by applying tapering processing to the end of the leading end portion 28*a*. The tip part 281 is brought into contact with the surface of the fixing roller 26, so as to be in contact with the transfer sheet which is apt to cling to the fixing roller 26, thereby peeling the transfer sheet. In this case, it is possible to improve the property of peeling the transfer sheet from the fixing roller 26 by the application of the tapering processing. Note that the tapering processing of the tip part 281, the formation of the slit processing portion 284, and the formation of the external shape of the plate shaped member 28' are realized by, for example, a method of punching out a flat metal plate by using a punching blade and a metallic mold.

The side portion 282 is formed into a hollow cylindrical shape by being wound in a roll shape along the forming direction of the slit processing portion 284, so as to serve as the pivotal portion 28*c*. For example, it is one of preferred forming processing methods that the side portion 282 is wound in a roll shape, and then the cylindrical shape is fixed by spot-welding the winding end of the cylindrical shape.

Each of the leading end portion 28*a* and the tailing end portion 28*b* is a flat plate having a predetermined length, and hence has a spring property as a flat spring. That is, both the leading end portion 28*a* and the tailing end portion 28*b* have a spring property which can be restored to a linear shape after being warped in the longitudinal direction of the main body portion 280.

As shown in FIG. 2, when being assembled to the case 29, the separating pawl 28 is supported by the shaft 30 held by the case 29. In this case, as shown in FIG. 3, a tailing end edge portion 285 of the tailing end portion 28*b* is brought into contact with a supporting step portion 291 provided in the case 29. Here, as can be seen from FIG. 3, three points of the position where the tip part 281 is brought into contact with the fixing roller 26, the position of the shaft 30, and the supporting position of the supporting step portion 291, are in a non-linear state in side view. That is, the supporting position of the supporting step portion 291 is set at a position comparatively higher than the position of the shaft 30.

For this reason, when the separating pawl 28 is assembled so as to be supported by the shaft 30, the tailing end portion 28*b* is bent and deformed to generate a spring force. The spring force of the tailing end portion 28*b* acts as a force of bending and deforming the leading end portion 28*a* via the pivotal portion 28*c*. Thus, a spring force is generated in the leading end portion 28*a* by the bending deformation, so that the tip part 281 is pressed onto the fixing roller 26. On the basis of such mechanism, it is possible to adjust the press-contact force of the tip part 281 to the surface of the fixing roller 26 by the spring property of the tailing end portion 28*b*.

This means that the press-contact force of the tip part 281 can be adjusted by adjusting the width of the tailing end portion 28*b*. That is, it is possible to change the press-contact force of the tip part 281 by making the tailing end portion 28*b* have a portion of a width different from that of the leading end portion 28*a*, in comparison with the case where the leading end portion 28*a* and the tailing end portion 28*b* are made to have the same width as shown in FIG. 6. Note that the "width" here is a width in the direction in which the shaft 30 passes through the pivotal portion 28*c*.

FIG. 7 shows an example in which the width (second width) of the tailing end portion 28*b* is reduced as a whole in comparison with the width (first width) of the leading end portion 28*a* except the tip part 281. On the contrary, FIG. 8 shows an example in which the width (second width) of the tailing end portion 28*b* is increased as a whole in comparison with the width (first width) of the leading end portion 28*a*.

In this way, the spring strength of the tailing end portion 28*b* can be adjusted by adjusting the width of the tailing end portion 28*b*, and hence by cutting and adjusting the width of the tailing end portion 28*b* at the time of maintenance or the like in the working site, it is possible to set the press-contact force of the tip part 281 in the working site. In the case where such adjustment is to be performed, it is preferred to set the width of the tailing end portion 28*b* as large as possible in order to extend the adjusting range of the spring strength.

FIG. 9 shows an example in which a cutout portion 28*d* is provided in the tailing end portion 28*b*, by cutting a part of the tailing end portion 28*b* in the width direction thereof. Here, an example is shown, in which a rectangular cutout portion 28*d* is formed at a substantially intermediate position between the pivotal portion 28*c* and the edge of the tailing end portion 28*b*. Even by forming such cutout portion 28*d*, it is possible to adjust the spring strength of the tailing end portion 28*b*, similarly to the case where the width of the tailing end portion 28*b* is adjusted as shown in FIG. 7 and FIG. 8.

By adjusting the cutout amount of the cutout portion 28*d*, it is possible to adjust the spring strength of the tailing end portion 28*b*. When the press-contact force of the tip part 281 is to be set on site, it is preferred to print a plurality of cutout lines 28*e* for adjusting the cutout amount of the cutout portion 28*d*, as shown in FIG. 10. This makes it possible to easily adjust the spring strength at the time of maintenance or the like in the working site.

Embodiment 2

Figure 11:
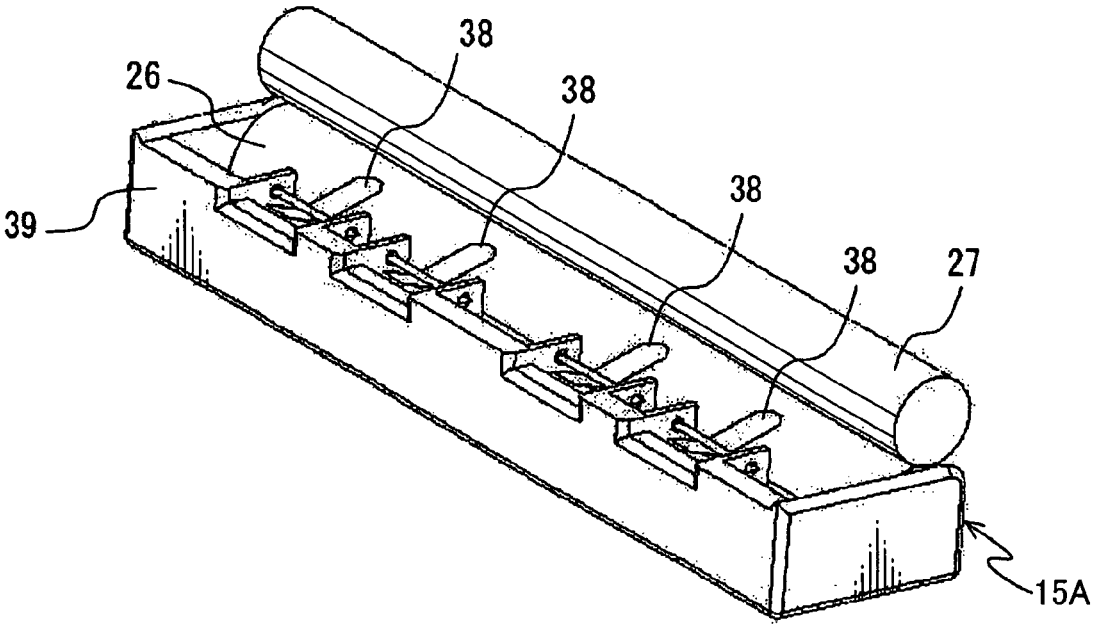
FIG. 11 is a perspective view of a fixing device according to another embodiment of the present invention viewed from the bottom surface thereof.
Figure 12:
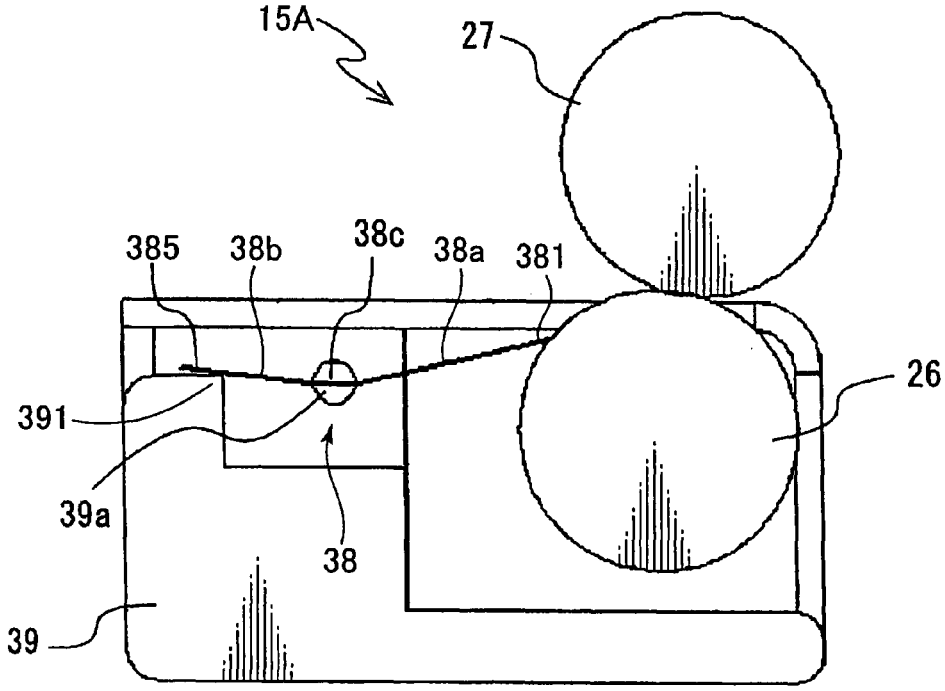
FIG. 12 is a sectional side view of the fixing device shown FIG. 11.
Figure 13:
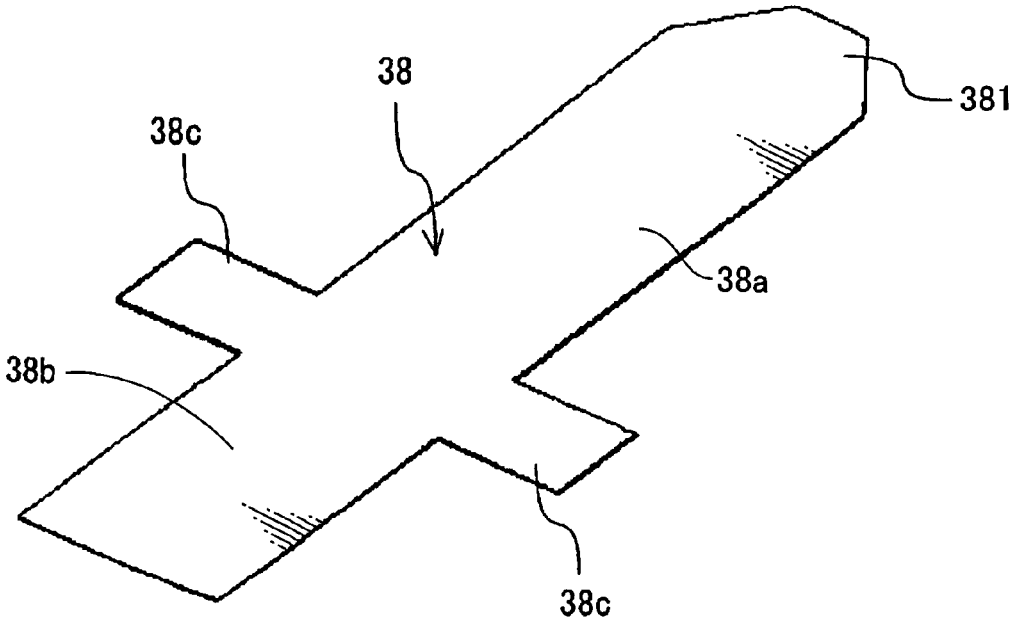
FIG. 13 is a perspective view of a separating pawl provided in the fixing device.
Figure 14:
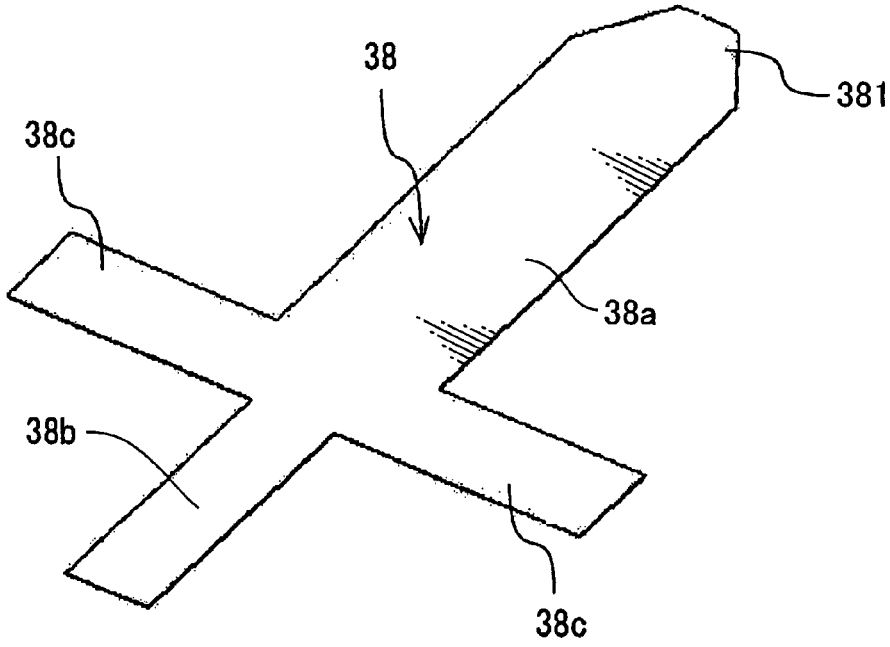
FIGS. 14 to 16 are perspective views of modifications of the separating pawl.
Figure 15:
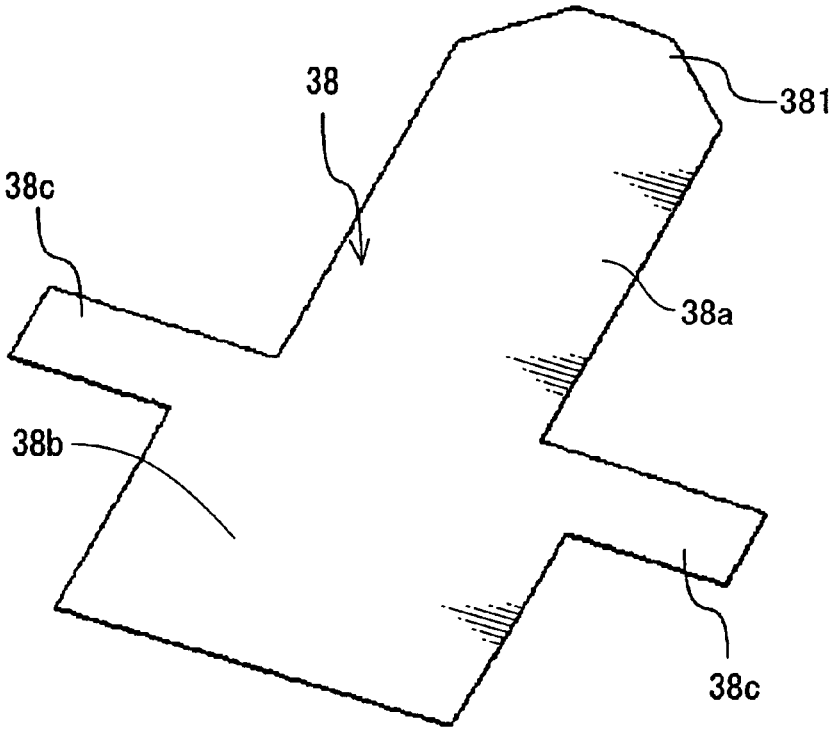
Figure 16:
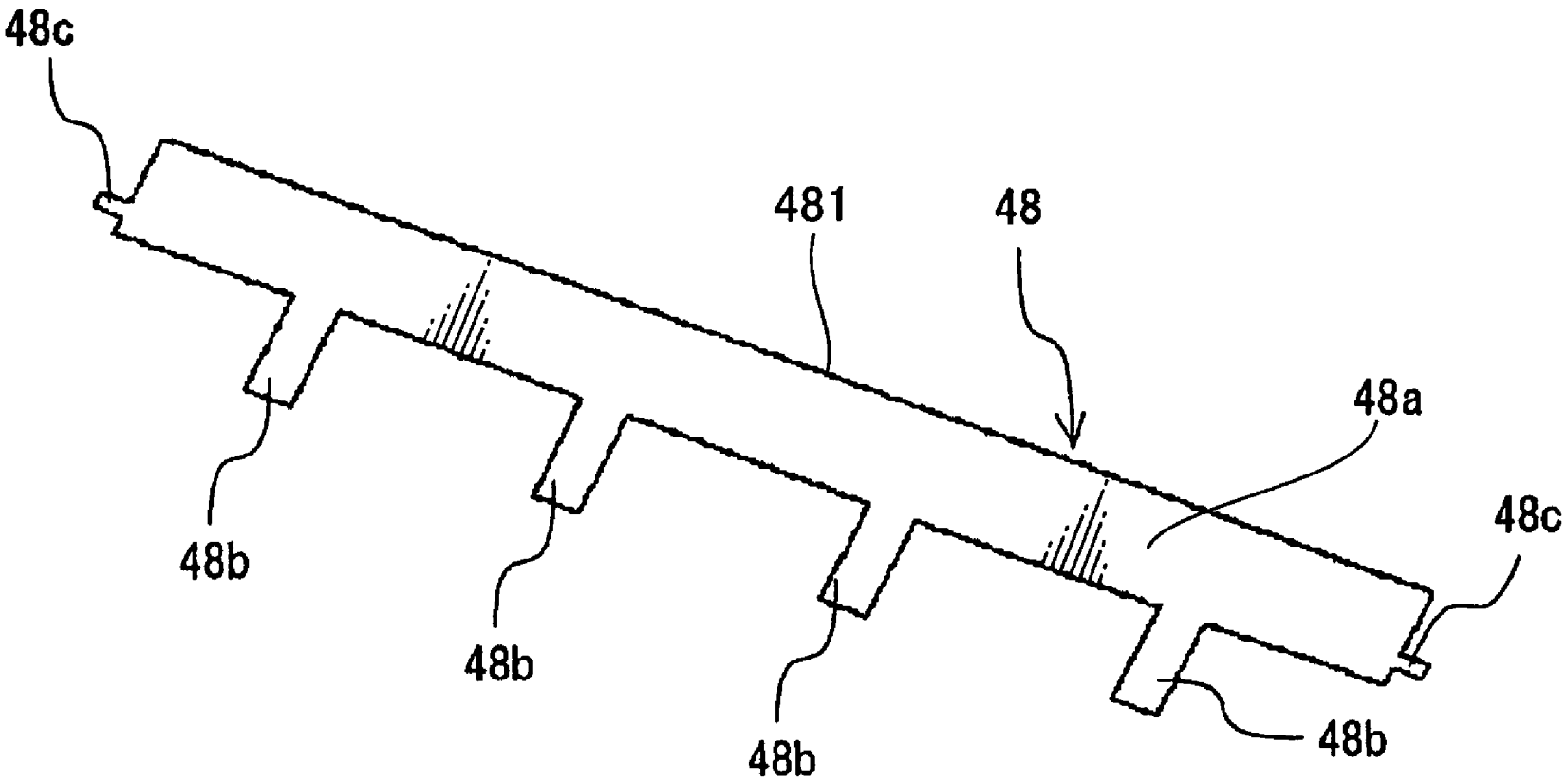

FIG. 11 to FIG. 16 show a fixing device 15A according to embodiment 2. FIG. 11 is a perspective view of the fixing device 15A viewed from the bottom surface thereof. FIG. 12 is a sectional side view of the fixing device 15A. FIG. 13 is a perspective view of a separating pawl. FIG. 14 to FIG. 16 are perspective views of modifications of the separating pawl of embodiment 2.

As shown in FIG. 11 and FIG. 12, the fixing device 15A includes a fixing roller 26 which fixes a toner image formed on the surface of a transfer sheet by the image forming portion 14, a pressing roller 27 which is made press contact with the fixing roller 26 so as to press the transfer sheet against the fixing roller 26, a plurality of separating pawls 38 whose tip part is made press contact with the surface of the fixing roller 26, and a case 39 which holds these in a state of a unit.

In the present embodiment, the separating pawl 38 is constituted by a processed article of a plate shaped member having a spring property. As the plate shaped member, it is possible to use, for example, a metal plate which has a thickness of 0.03 to 0.1 mm, and is made of stainless steel, phosphor bronze, or the like. Further, it is preferred that coating processing of coating or sticking fluororesin is applied to at least the contact surface side with the fixing roller 26.

As shown in FIG. 13, the separating pawl 38 has a leading end portion 38*a* and a tailing end portion 38*b*. A tip part 381 which is made press contact with the roller surface of the fixing roller 26 is formed in the leading end portion 38*a*. Between the leading end portion 38*a* and the tailing end portion 38*b*, a collar-shaped shaft 38*c* formed integrally with these portions is provided. The shaft 38*c* is engaged with a shaft hole 39*a* formed in the case 39.

The separating pawl 38, whose main body portion is formed by connecting the leading end portion 38*a* to the tailing end portion 38*b* in the same width and in the linear state similarly to the separating pawl in embodiment 1 shown in FIG. 6, is different from the separating pawl in embodiment 1 in that the side portion (shaft 38*c*) having a predetermined projecting length in the direction perpendicularly intersecting the longitudinal direction of the main body portion is integrated with the main body portion in the longitudinal direction as a whole. The side portion constitutes a pivotal portion as the shaft 38*c* as it is, without being subjected to particular processing.

The manner of assembling the separating pawl 38 to the case 39 is the same as that shown in FIG. 3. The shaft 38*c* is engaged with the shaft hole 39*a* of the case 39, so that a tailing end edge portion 385 of the tailing end portion 38*b* is brought into contact with a supporting step portion 391 provided in the case 39. Here, as shown in FIG. 13, three points of the position where the tip part 381 is brought into contact with the fixing roller 26, the position of the shaft hole 39*a*, and the supporting position of the supporting step portion 391, are in a non-linear state in side view. The supporting position of the supporting step portion 391 is set at a position comparatively higher than the position of the shaft hole 39*a*.

For this reason, when the separating pawl 38 is assembled so as to be supported by the shaft hole 39*a*, the tailing end portion 38*b* is bent and deformed to generate a spring force. The spring force of the tailing end portion 38*b* acts as a force of bending and deforming the leading end portion 38*a* via the shaft 38*c*. Thus, a spring force is generated in the leading end portion 38*a* by the bending deformation, so that the tip part 381 is pressed onto the fixing roller 26. On the basis of such mechanism, it is possible to adjust the press-contact force of the tip part 381 to the surface of the fixing roller 26 by the spring property of the tailing end portion 38*b*.

Similarly to embodiment 1, the press-contact force of the tip part 381 can be adjusted by adjusting the width of the tailing end portion 38*b*. FIG. 14 shows an example in which the width of the tailing end portion 38*b* is reduced as a whole in comparison with the width of the leading end portion 38*a* except the tip part 381. On the contrary, FIG. 15 shows an example in which the width of the tailing end portion 38*b* is increased as a whole in comparison with the width of the leading end portion 38*a*.

There is shown a specific example of the size of the separating pawl 38 in which the width of the tailing end portion 38*b* is increased as compared with the width of the leading end portion 38*a*, as in the separating pawl 38 shown in FIG. 15. For example, the minimum width of the tapering portion of the tip part 381 is 1.5 mm, the width of the leading end portion 38*a* is 3.0 mm, the width of the tailing end portion 38*b* is 5.0 mm, the length from the tip of the tip part 381 to the center of the shaft 38*c* is 20.0 mm, and the length from the trailing edge of the tailing end portion 38*b* to the center of shaft 38*c* is 15.0 mm.

FIG. 16 is a perspective view showing a separating pawl 48 according to another modification of embodiment 2. In the separating pawl 48, a tip part 481 of a leading end portion 48*a* has a length extending over substantially the whole width of the fixing roller 26, and tailing end portions 48*b* are integrally provided at a plurality of positions with respect to the leading end portion 48*a*. A shaft 48*c* is integrally formed on the side portion between the leading end portion 48*a* and the tailing end portion 48*b*.

(Image Formation Processing)

Referring to FIG. 1, a transfer sheet is sent out from the sheet tray units 3, 4 and 5 or the manual feed tray 6, and conveyed to the resist roller pair 13 along the conveyance path 11. As a result, the tip of the transfer sheet is abutted against the nip portion of the resist roller pair 13.

In this case, the transfer sheet is sent by the sheet conveying roller during a time period until the resist roller pair 13 starts to be rotated, and thereby buckled in the conveyance path 11 (the leading edge side of the transfer sheet is partially bent and deformed). As a result, the skew feed is corrected by the buckling. Then, the rotation of the resist roller pair 13 is started at the timing when the image formed on the surface of the photoreceptor drum 20 becomes coincident with the leading edge of the transfer sheet, so that the transfer sheet is sent into the transfer position between the photoreceptor drum 20 and the transfer device 24 by the resist roller pair 13.

In the image forming portion 14, the photoreceptor drum 20 is rotatably driven at a predetermined process speed (circumferential speed) by a drive mechanism (not shown), and the surface of the photoreceptor drum 20 is uniformly charged to a predetermined polarity and an electric potential by the electrifying device 21.

After the photoreceptor drum 20 is electrostatically charged, an electrostatic latent image is formed on the surface of the photoreceptor drum 20 by the exposing device 22. Here, the exposing device 22 performs rasterization on the basis of, for example, image data read by the copying machine function of the scanner portion using the ADF 7, image data received by the facsimile function via a telephone line, and image data outputted by the printer function from a personal computer or the like connected via a communication line such as a network.

Further, the exposing device 22 irradiates laser beam onto the surface of the photoreceptor drum 20 on the basis of the rasterizing information, and forms an electrostatic latent image corresponding to the image information by removing the electric charges of the parts irradiated by the laser beam. A toner having an electric charge is electrostatically stuck to the electrostatic latent image formed on the surface of the photoreceptor drum 20 by the developing device 23, so that the electrostatic latent image is developed as a toner image. The toner image stuck to the surface of the photoreceptor drum 20 is transferred to a transfer sheet as a transfer image by the transfer device 24. Here, in the photoreceptor drum 20 whose toner image formed thereon was transferred to the transfer sheet, the residual toner and the like is removed by the cleaning device 25, and the residual electric charges are removed for the electrostatic charging at the time of next image formation.

Here, in the case when one-surface printing is performed to the transfer sheet, the transfer sheet is sent to the fixing device 15 (15A), so that the toner image is fixed. The transfer sheet sent out from the fixing device 15 (15A) is conveyed along a sheet discharge path, while being peeled by the separating pawl 28 (38, 48), and discharged on the paper discharge tray 10 by a sheet discharge roller.

In the case where the double-surface printing is performed to the transfer sheet, the transfer sheet sent out from the fixing device 15 is guided into the branch path 16. The transfer sheet guided into the branch path 16 is sent into the switchback path 17, with the leading edge side of the transfer sheet placed on the front side, and then sent out to the reverse path 18 from the switchback path 17, with the trailing edge of the transfer sheet placed on the front side. Thereby, the front and rear surfaces of the transfer sheet are reversed.

The transfer sheet whose front and rear surfaces are reversed is returned to the conveyance path 11 from the reverse path 18. Thereafter, similarly to the case of the above described one-surface printing, the transfer sheet is conveyed by the sheet conveying roller and the resist roller pair 13, and an image is formed on the other surface as the unprinted surface through the image forming portion 14 and the fixing device 15, so that the double-surface printing is completed. Thereafter, the transfer sheet subjected to the double-surface printing is conveyed as it is in the conveyance path 11, so as to be discharged on the paper discharge tray 10.

Note that when the above described transfer sheet subjected to the one-surface printing is discharged on the paper discharge tray 10 in the state where the front and rear surfaces of the transfer sheet are reversed, the transfer sheet discharged from the fixing device 15 is sent to the reverse path 18 via the branch path 16. Then, the transfer sheet is sent into the switch-back path 17, with the leading edge side of the transfer sheet placed on the front side, and then discharged on the paper discharge tray 10 via the reverse discharge path 19, with the trailing-edge side of the transfer sheet placed on the front side.

The transfer sheet subjected to the image formation processing is discharged on the paper discharge tray 10. When there is no next image formation processing, the drive of each drive system, and the like, is stopped after the lapse of a predetermined time period from when the trailing-edge of the transfer sheet is detected by the resist sensor 12.

As described above, in the fixing device 15 (15A) according to the present embodiment, the tailing end portion of the separating pawl 28 (38, 48) is directly rotatably supported to the case 29(39) without being stuck and fixed to the thin-walled bracket or the like. This makes it possible to reduce the number of components, and to facilitate the mounting work of the separating pawl 28 (38, 48) at the time of assembling the composite machine 1, or the like, as a result of which the versatility can be improved.

Further, it is possible to realize common use of the separating pawl 28 (38, 48), and also to realize simplification of the control of inventory, or the like, by enabling adaptation of the separating pawl in the working site.

Further, since the separating pawl 28 (38, 48) is directly rotatably supported by the case 29(39), even when the separating pawl 28 (38, 48) needs to be exchanged during the maintenance work, it is possible to easily exchange the separating pawl 28 (38, 48) on the spot. Therefore, the versatility can be improved also from the viewpoint of maintenance or the like.

(Modifications)

According to the invention, the following modifications may be made.

[1] In the above described embodiment, the composite machine 1 is explained as an example of the image forming apparatus to which the fixing device 15 according to the present invention is applied. Alternatively, it is of course possible to apply the present invention to various dedicated machines such as a copying machine, a printer and a facsimile.

Figure 17:
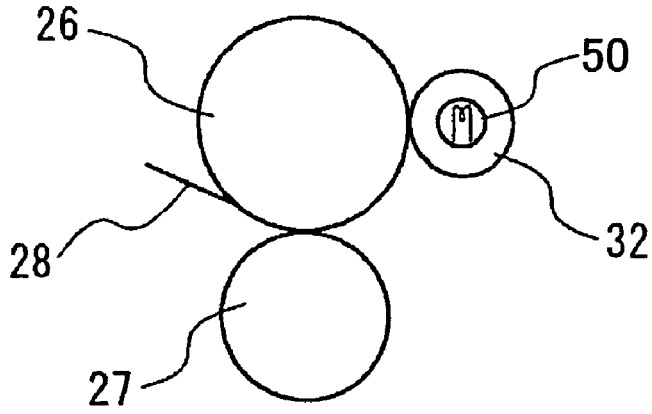
FIGS. 17 to 21 are diagrams showing a fixing device according to still another embodiment of the present invention.

[2] As the fixing device 15 (15A) of the above described embodiment, the fixing device using the fixing roller 26 and the pressing roller 27 is explained. In addition, for example, as shown in FIG. 17, it is also possible to apply the present invention to a fixing device of a type in which the surface of fixing roller 26 is conduction heated by bringing a heating roller 32 provided with a heating member such as the halogen heater 50 in the inside thereof into contact with the surface of the fixing roller 26. Of course, it is also possible to apply the present invention to a fixing device in which an induction heating system is adopted.

Figure 18:
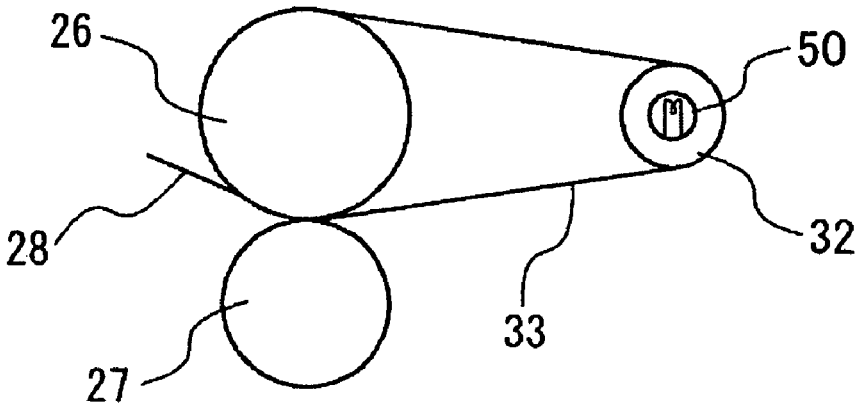
Figure 19:
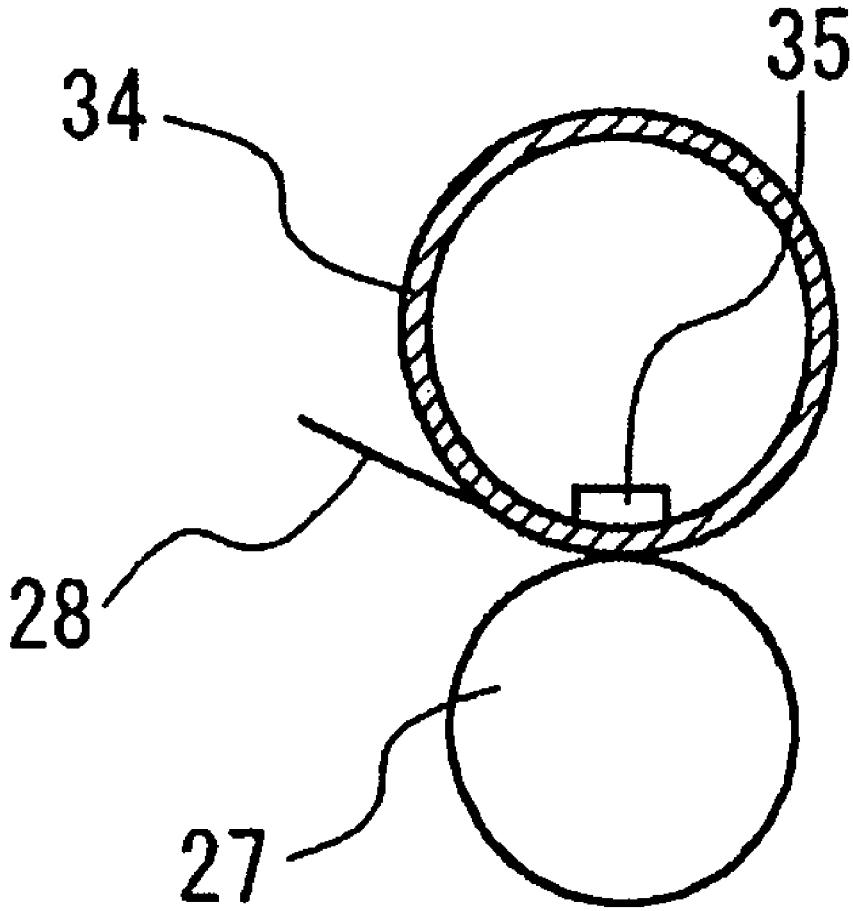

[3] Further, as shown in FIG. 18, it is also possible to apply the present invention to a fixing device in which the heating roller 32 provided with the heating member such as the halogen heater 50 in the inside thereof is arranged away from the fixing roller 26, and the surface of the fixing roller 26 is conduction heated by rotatably and movably providing a conduction belt 33 between the fixing roller 26 and the heating roller 32, or to a fixing device in which as shown in FIG. 19, a fixing belt 34 is provided in place of the fixing roller 26, and the fixing belt 34 is directly heated by providing a heating body 35 in contact with the inner wall surface of the fixing belt 34.

Figure 20:
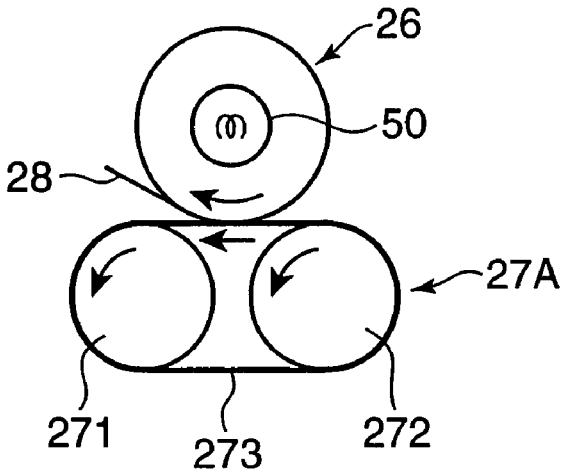
Figure 21:
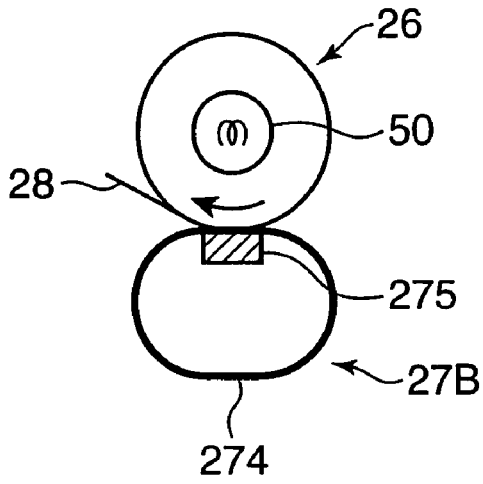

[4] Further, as shown in FIG. 20, the fixing device may be adapted to use a pressing unit 27A constituted by a pair of rollers 271 and 272 and a pressing endless belt 273 stretched over the rollers in place of the above described pressing roller 27. Alternatively, as shown in FIG. 21, the fixing device may be adapted to use a pressing unit 27B constituted by a pressing endless belt 274 and a pressing pad 275 in place of the pressing roller 27.

Figure 22:
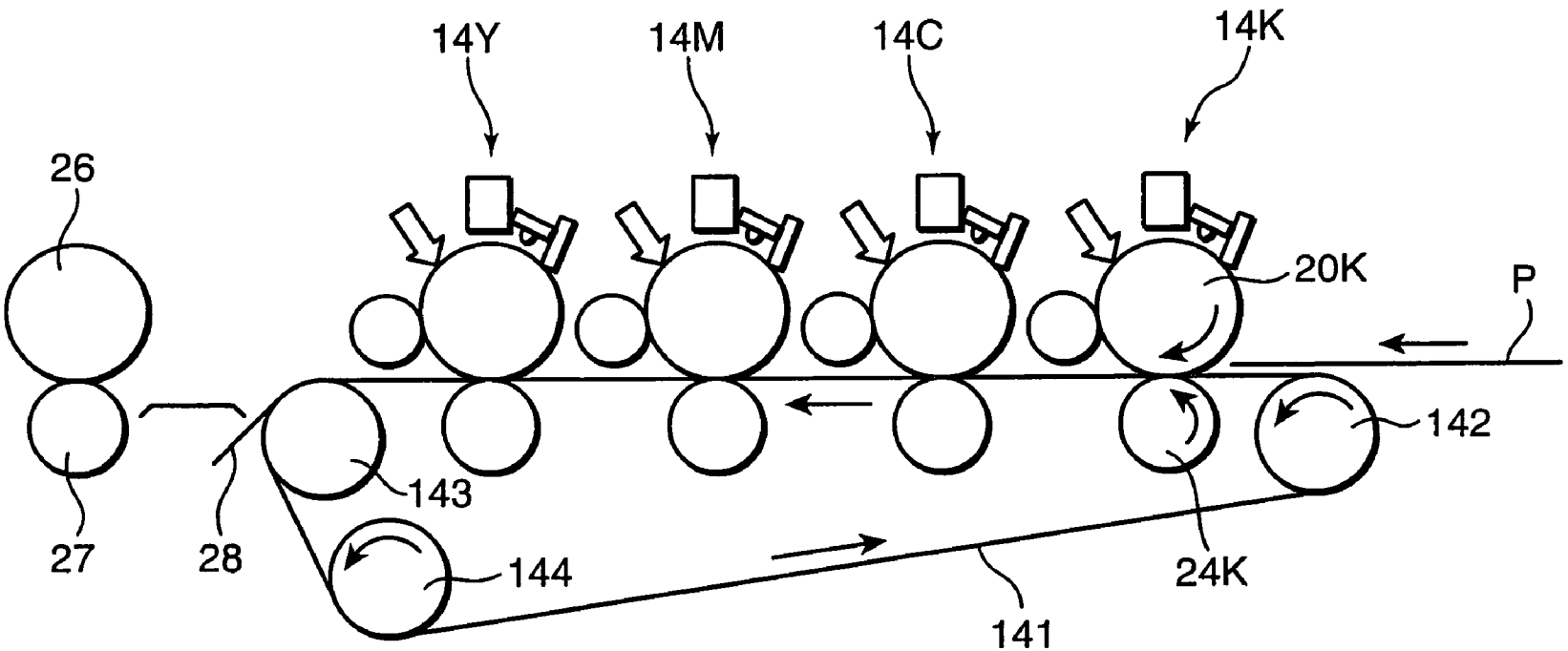
FIGS. 22 and 23 are simplified illustrations showing a sheet conveying device according to further embodiment of the present invention.

[5] In the above described embodiments, there are shown examples in which the present invention is applied to the fixing device. In addition to these, the present invention is applicable to various sheet conveying devices. For example, FIG. 22 shows a sheet conveying device in an image forming portion of a tandem-type color printer. The image forming portion includes image forming units of respective colors which are arranged in tandem, that is, a unit 14Y for yellow, a unit 14M for magenta, a unit 14C for cyan, and a unit 14K for black, respectively, and a conveying belt 141 passing a nip between a photoreceptor drum (20K) and a transfer roller (24K) of each unit.

The conveying belt 141 is stretched over a plurality of rollers 142, 143 and 144, and conveys a sheet P by making the sheet electrostatically attracted onto the outer peripheral surface of the belt. A toner image of each color respectively formed by the image forming unit of each color is successively applied on the sheet P in an overlapped state. Then, the sheet P on which a color toner image is formed, is guided to the nip portion of the fixing roller 26 and the pressing roller 27, so as to be subjected to the fixing processing.

The separating pawl 28 is made press contact with the outer peripheral surface of the conveying belt 141 at a position of the inlet side of the fixing roller pair. Here, the separating pawl 28 performs a function of separating the sheet P electrostatically attracted to the outer peripheral surface of the conveying belt 141, and surely guiding the sheet P to the fixing roller pair.

Figure 23:
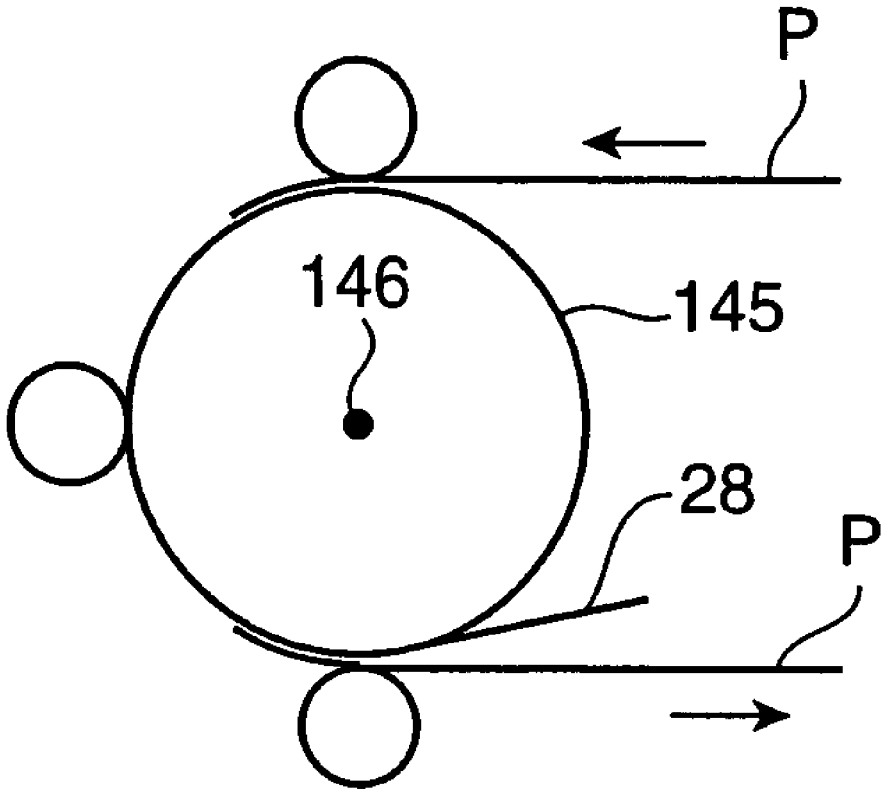

[6] FIG. 23 shows an example of another sheet conveying device, and shows a sheet conveying device in which a large-diameter conveyance roller 145 rotated around a axis 146 is used. Here, the sheet P is conveyed in a close contact state along the outer peripheral surface of the conveyance roller 145, so that the direction of the sheet P is changed by 180°. The separating pawl 28 is made press contact with the outer peripheral surface of the conveyance roller 145 at the sheet outlet side thereof.

In the sheet conveying device, when a sheet P with low stiffness, such as a thin sheet, is conveyed, the sheet P is liable to be wound around the conveyance roller 145. The separating pawl 28 contributes to prevent the winding beforehand, and to realize smooth conveyance of the sheet P.

It will be seen that the foregoing embodiments and modifications mainly have the following inventive features.

A fixing device comprises: a pair of rotating bodies forming a nip portion, for fixing an image formed on a surface of a sheet; and a separating pawl having a leading end portion and a tailing end portion, a tip part of the leading end portion being made press contact with a surface of at least one of the pair of rotating bodies, and having a pivotal portion integrally formed between the leading end portion and the tailing end portion. The tailing end portion has a spring property capable of adjusting press-contact force of the tip part.

Also, an image forming apparatus comprises: an image forming portion adapted to perform transfer processing to transfer a toner image onto a sheet; and a fixing portion adapted to perform fixing processing of the toner image by heating the sheet. The fixing portion is provided with the constitution of the above-mentioned fixing device.

According to these constitutions, it is possible to adjust the press-contact force of the tip part to the rotating body surface by the spring property of the tailing end portion. Further, the separating pawl is not fixedly supported, but is supported by the pivotal portion. This makes it possible to reduce the number of components, and to facilitate the mounting work of the separating pawl. Accordingly, the versatility can be improved.

The leading end portion may be preferably made to have a spring property. Accordingly, it is possible to effectively transmit the spring property of the tailing end portion to the tip part.

The pivotal portion may be preferably formed in a shape of bearing, or in a shape of shaft.

The separating pawl may be preferably made of a plate shaped member, which includes a main body portion forming the leading end portion and the tailing end portion which are connected with each other straightly, and side portions arranged at both sides of the main body portion for constituting the pivotal portion. According to the constitution, it is possible to easily form the separating pawl by using the plate shaped member.

The side portion may preferably have a predetermined length in a longitudinal direction of passing the leading end portion and the tailing end portion, and be integrated with the main body portion by a local connecting portion, so that a bearing-shaped pivotal portion can be formed by making the side portion processed into a cylindrical shape.

The tailing end portion may be preferably adapted to include a portion having a width different from that of the leading end portion. According to the constitution, it is possible to adjust the spring force of the tailing end portion by the width size of the tailing end portion.

It may be appreciated that the leading end portion has a first width as a whole except the tip part, and the tailing end portion has a second width which is narrower than the first width as a whole, or which is wider than the first width as a whole.

Alternatively, it may be appreciated that the tailing end portion has a cutout portion formed by cutting a part of the tailing end portion in the width direction. According to the constitution, it is possible to adjust the spring force of the tailing end portion by the degree of cutting of the tailing end portion.

The side portion may be preferably made to have a predetermined projecting length in a direction perpendicularly intersecting the longitudinal direction of passing the leading end portion and the tailing end portion, and to be integrated with the main body portion in the longitudinal direction as a whole, thereby forming a shaft-shaped pivotal portion. The constitution has an advantage that the pivotal portion can be formed without the need to specifically process the side portion.

It may be appreciated that the leading end portion has a length extending over substantially the whole width of the rotating body, and the tailing end portion has a plurality of segments integrally formed with the leading end portion.

A sheet conveying device comprises: a conveying body having a rotating conveying surface capable of conveying a sheet in a close contact state; and a separating pawl having a leading end portion and a tailing end portion, a tip part of the leading end portion being made press contact with the conveying surface of the conveying body, and having a pivotal portion integrally formed between the leading end portion and the tailing end portion. The tailing end portion has a spring property capable of adjusting the press-contact force of the tip part.

The conveying body may be preferably a rotating conveying belt which is stretched over a plurality of rollers. Also, the conveying body may be preferably a conveying roller which is rotated around an axis.

This application is based on patent application No. 2006-208795 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device comprising:

a pair of rotating bodies forming a nip portion, for fixing an image formed on a surface of a sheet;

a separating pawl having a leading end portion and a tailing end portion, a tip part of the leading end portion being made in press contact with a surface of at least one of the pair of rotating bodies, and having a pivotal portion integrally formed between the leading end portion and the tailing end portion, the tailing end portion having a spring property capable of adjusting press-contact force of the tip part;

a case accommodating the separating pawl and directly supporting the separating pawl rotatably through the pivotal portion of the separating pawl; and the pivotal portion of the separating pawl is formed into a cylindrical shape and wherein the case includes a shaft that passes through the pivotal portion of the separating pawl for directly supporting the separating pawl rotatably through the pivotal portion of the separating pawl.

2. The fixing device according to claim 1, wherein the leading end portion has a spring property.

3. The fixing device according to claim 1, wherein the pivotal portion has a bearing shape or a shaft shape.

4. The fixing device according to claim 1, wherein the separating pawl is made of a plate shaped member, and wherein the plate shaped member includes: a main body portion for forming the leading end portion and the tailing end portion which are connected with each other straightly; and side portions arranged at both sides of the main body portion for constituting the pivotal portion.

5. The fixing device according to claim 4,
wherein the side portions each have a predetermined length in a longitudinal direction of passing the leading end portion and the tailing end portion, and is integrated with the main body portion by a local connecting portion, and the side portion is processed into a cylindrical shape to constitute the pivotal portion.

6. The fixing device according to claim 4,
wherein the tailing end portion includes a portion having a width different from the width of the leading end portion.

7. The fixing device according to claim 6,
wherein the leading end portion has a first width as a whole except the tip part, and
wherein the tailing end portion has a second width narrower than the first width as a whole or wider than the first width as a whole.

8. The fixing device according to claim 4,
wherein the tailing end portion has a cutout portion formed by cutting a part of the tailing end portion in the width direction.

9. The fixing device according to claim 4,
wherein the side portion has a predetermined projecting length in a direction perpendicularly intersecting the longitudinal direction of passing the leading end portion and the tailing end portion, and is integrated with the main body portion along the longitudinal direction as a whole, and wherein the side portion forms a shaft-shaped pivotal portion.

10. The fixing device according to claim 1,
wherein the leading end portion has a length extending over substantially the whole width of the rotating body, and the tailing end portion has a plurality of segments integrally connected with the leading end portion.

11. An image forming apparatus comprising;
an image forming portion adapted to perform transfer processing to transfer a toner image onto a sheet; and
a fixing portion adapted to perform fixing processing of the toner image by heating the sheet,
wherein the fixing portion includes:
a pair of rotating bodies forming a nip portion, for fixing the image formed on a surface of the sheet;
a separating pawl having a leading end portion and a tailing end portion, a tip part of the leading end portion being made in press contact with a surface of at least one of the pair of rotating bodies, and having a pivotal portion integrally formed between the leading end portion and the tailing end portion, the tailing end portion having a spring property capable of adjusting press-contact force of the tip part;
a case accommodating the separating pawl and directly supporting the separating pawl rotatably through the pivotal portion of the separating pawl; and
the pivotal portion of the separating pawl is formed into a cylindrical shape and wherein the case includes a shaft that passes through the pivotal portion of the separating pawl for directly supporting the separating pawl rotatably through the pivotal portion of the separating pawl.

12. The image forming apparatus according to claim 11,
wherein the leading end portion has a spring property.

13. The image forming apparatus according to claim 11,
wherein the pivotal portion has a bearing shape or a shaft shape.

14. The image forming apparatus according to claim 11,
wherein the separating pawl is made of a plate shaped member, and
wherein the plate shaped member includes: a main body portion for forming the leading end portion and the tailing end portion which are connected with each other straightly; and side portions arranged at both sides of the main body portion for constituting the pivotal portion.

15. The image forming apparatus according to claim 14,
wherein the side portions each have a predetermined length in a longitudinal direction of passing the leading end portion and the tailing end portion, and is integrated with the main body portion by a local connecting portion, and the side portion is processed into a cylindrical shape to constitute the pivotal portion.

16. The image forming apparatus according to claim 14,
wherein the tailing end portion includes a portion having a width different from the width of the leading end portion.

17. The image forming apparatus according to claim 16,
wherein the leading end portion has a first width as a whole except the tip part, and
wherein the tailing end portion has a second width narrower than the first width as a whole or wider than the first width as a whole.

18. The image forming apparatus according to claim 14,
wherein the tailing end portion has a cutout portion formed by cutting a part of the tailing end portion in the width direction.

19. The image forming apparatus according to claim 14,
wherein the side portion has a predetermined projecting length in a direction perpendicularly intersecting the longitudinal direction of passing the leading end portion and the tailing end portion, and is integrated with the main body portion along the longitudinal direction as a whole, and wherein the side portion forms a shaft-shaped pivotal portion.

20. The image forming apparatus according to claim 11,
wherein the leading end portion has a length extending over substantially the whole width of the rotating body, and the tailing end portion has a plurality of segments integrally connected with the leading end portion.

21. A sheet conveying device comprising:
a conveying body having a rotating conveying surface capable of conveying a sheet in a close contact state; and
a separating pawl having a leading end portion and a tailing end portion, a tip part of the leading end portion being made press contact with the conveying surface of the conveying body, and having a pivotal portion integrally formed between the leading end portion and the tailing end portion, the tailing end portion having a spring property capable of adjusting the press-contact force of the tip part;
a case accommodating the separating pawl and directly supporting the separating pawl rotatably through the pivotal portion of the separating pawl; and
the pivotal portion of the separating pawl is formed into a cylindrical shape and wherein the case includes a shaft that passes through the pivotal portion of the separating pawl for directly supporting the separating pawl rotatably through the pivotal portion of the separating pawl.

22. The sheet conveying device according to claim 21,
wherein the conveying body is a rotating conveying belt which is stretched over a plurality of rollers.

23. The sheet conveying device according to claim 21,
wherein the conveying body is a conveying roller which is rotated around an axis.

* * * * *